US005211577A

United States Patent [19]

Daugherty

[11] Patent Number: 5,211,577

[45] Date of Patent: May 18, 1993

[54] PRESSURE-ACTUATED GOLD DOT CONNECTOR

[75] Inventor: Robert E. Daugherty, Irvine, Calif.

[73] Assignee: Hughes Aircraft Company, Los Angeles, Calif.

[21] Appl. No.: 957,294

[22] Filed: Oct. 6, 1992

[51] Int. Cl.[5] ..... H01R 13/00

[52] U.S. Cl. ..... 439/493

[58] Field of Search ..... 439/65-67, 439/74, 77, 493

[56] References Cited

U.S. PATENT DOCUMENTS 4,629,271 12/1986 Awano ..... 439/493
4,913,656 4/1990 Gordon et al. ..... 439/493
5,009,605 4/1991 Crumly et al. ..... 439/493

*Primary Examiner*—Joseph H. McGlynn
*Attorney, Agent, or Firm*—Terje Gudmestad; Wanda K. Denson-Low

[57] ABSTRACT

An electrical connector (10) is provided in which a flexible circuit (11) is attached to the connector assembly which is associated with a circuit board (12) by sliding onto pins (56) that project from the board (12). The connector assembly includes a housing (13) within which is a pressure bar (29) bonded to a pad (37) that is bonded to the flexible circuit (11). A slide (41) on the exterior of the housing (13) can actuate a spring (54) to cause the pressure bar (29) to press the contacts (39) on the flexible circuit (11) against the contacts (40) of a circuit board (12).

14 Claims, 2 Drawing Sheets

PRESSURE-ACTUATED GOLD DOT CONNECTOR

BACKGROUND OF THE INVENTION

1. Field of the Invention

This invention pertains to electrical connectors, in particular to connectors for interconnecting flexible circuits and printed circuit boards.

2. Description of Related Art

Electrical connections frequently are made between flexible circuits and printed circuit boards. The flexible circuit may consist of a flat flexible substrate on which are electrical conductors which at an end portion of the circuit terminate in raised gold plated protuberances which form electrical contacts. These gold dots must be pressed firmly against contact pads on the printed circuit board in order to complete an electrical connection.

Conventional connectors for connecting flex circuits to printed circuit boards are relatively bulky and complicated. Although a gold dot flex circuit is inherently small in size, the advantage of this may be lost when utilizing bulky conventional connectors. Space saving is a matter of increasing importance in such electrical circuits. With the size and complexity of conventional connectors is the added penalty of relatively high cost manufacture and greater weight than is desirable.

SUMMARY OF THE INVENTION

The present invention provides an electrical connector in which the flexible circuit and connector hardware function as one unit. The connection to the printed circuit board is very easily achieved. A high density of electrical contacts is possible and impedance matching to approximately 1 GHz can be accomplished.

The connector assembly includes a housing having an open bottom. Within the housing is a pressure bar which is movable vertically relative to the body. A resilient pad is adhesively secured to the underside of the pressure bar and in turn secured by adhesive to the flexible circuit. A slide manipulated from the exterior of the housing can deflect a leaf spring which will exert a downward force relative to the housing on the pressure bar.

The housing includes slotted end parts which receive alignment pins projecting from the printed circuit board. In that location the board is provided with a permanent aluminum stiffener. It is a simple matter to slide the housing and its associated components, including the flexible circuit, into position from the side. There it is aligned relative to the board by the pins. Movement of the slide after the housing has been placed on the circuit board causes the pressure bar to force the flexible circuit against the printed circuit board. This causes the contact dots on the flexible circuit to be forced against the contact pads of the circuit board, forming an electrical connection.

The connection is particularly easy to accomplish, yet it is secure and effective in its results. The connector is small in size, uncomplicated, light in weight and reliable in its operation. Few operating parts are necessary.

DESCRIPTION OF THE PREFERRED EMBODIMENTS

Figure 1:
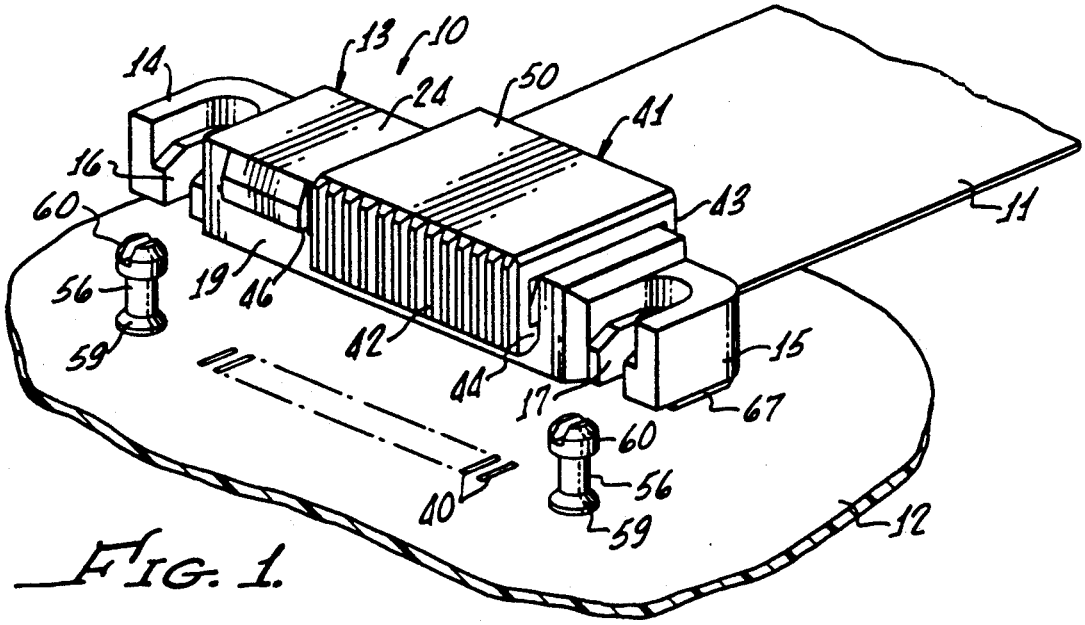
FIG. 1 is a perspective view of the connector of this invention and a printed circuit board to which it is to be connected.
Figure 2:
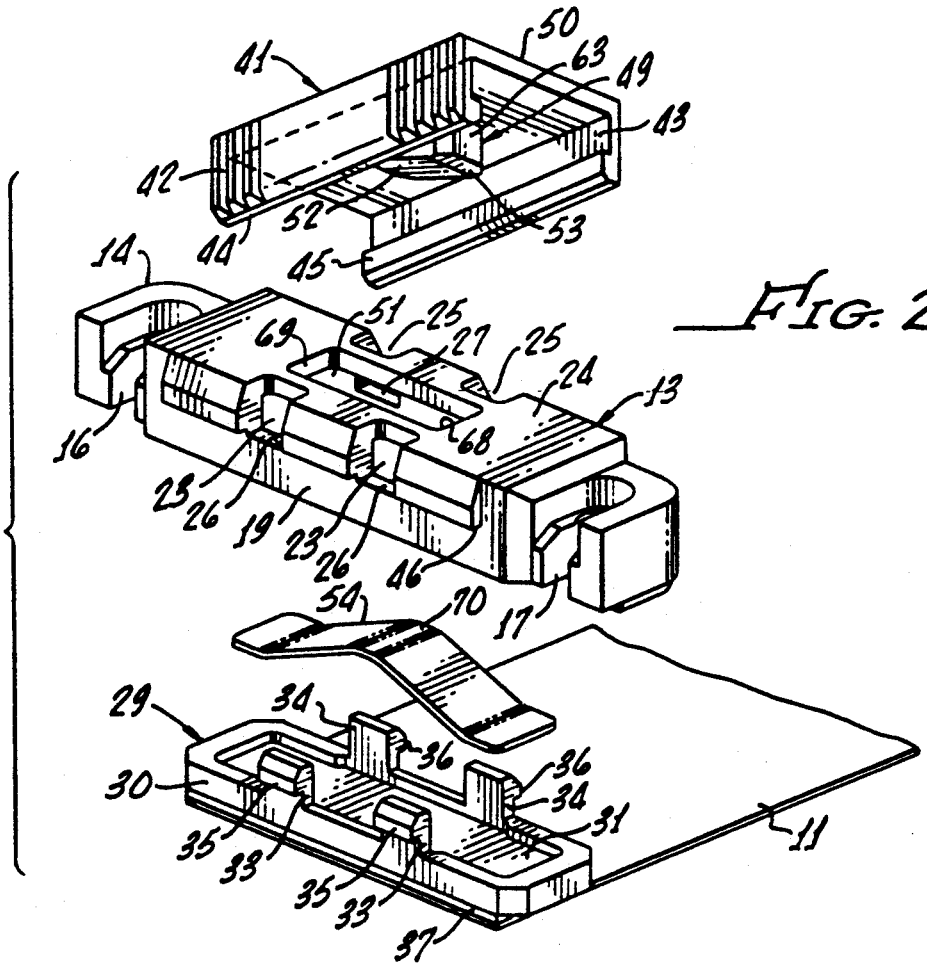
FIG. 2 is an exploded perspective view of the components of the connector.

The connector 10 of this invention serves to connect the conductors of a flexible circuit 11 to the conductors of a wiring board 12. The connector 10 and flexible circuit 11 are secured together as a unit which is joined to the printed circuit board.

The connector 10 includes an elongated body 13, made of an aluminum alloy, which has a hollow interior and an open bottom. At the opposite ends of the body 13, beyond the hollow interior, are projecting parts 14 and 15. These are provided with parallel slots 16 and 17 which have open outer ends on the same side of the body 13 and are used in securing the connector 10 to the wiring board 12, as explained below. The central portion of the body 13 includes opposed parallel sidewalls 19 and 20, and end walls 21 and 22, which define a rectangular chamber. Two spaced openings 23 are provided in the wall 19, extending also into a portion of the top wall 24 of the body 13. Similar openings 25 are provided in the sidewall 20 and are positioned opposite the openings 23. The bottom edges 26 and 27 of the openings 23 and 25, respectively, are flat and parallel to the top wall 24 and the bottom edge 28 of the body 13.

Received in the lower portion of the interior of the body 13 is a pressure bar 29, which may be of aluminum material. The pressure bar 29 includes a lower flat plate 30, with a recess 31 in its upper surface, that fits rather closely within the walls 19, 20, 21 and 22 of the body 13. Two spaced tabs 33 project upwardly from one side edge of the plate 30 and similar tabs 34 project from the opposite side edge of the plate 30. The tabs 33 and 34 are opposite from each other. Flanges 35 extend laterally outwardly from the upper portions of the tab 33 and extend over the bottom edges of the openings 24. Similar flanges 36 of the tabs 34 fit above the bottom straight edges of the openings 26 and the wall 20. The pressure bar 29 is assembled in the body 13 by deflecting the tabs 33 and 34 inwardly as they move along the sidewalls to the openings 23 and 25. In this manner the pressure bar 29 is permitted movement along a straight path which is vertical relative to the body 13, and the tabs 33 and 34 prevent the pressure bar from falling out of the open bottom of the body.

Adhesively, bonded to the undersurface of the plate 30 is a resilient pad 37 of elastomeric materials, such as silicone rubber. The opposite side of the pad 37 is adhesively secured to the flexible circuit 11. The conductors of the flexible circuit 11 terminate in raised features in the form of gold dots 39 which face downwardly away from the connector 10. The raised features 39 provide the contacts which make electrical connections with the contact pads 40 of the wiring board 12.

A slide 41 fits over the upper portion of the body 13 and includes opposite sidewalls 42 and 43, with serrated outer surfaces, which extend down along the exteriors of the upper portions of the walls 19 and 20 of the body 13. Inwardly projecting flanges 44 and 45 are at the bottom edges of the sidewalls 42 and 43 of the slide 41. The flanges 44 and 45 fit beneath downwardly facing shoulders 46 and 47 on the sidewalls 19 and 20 of the body 13, which are parallel to the upper wall 24 of the body. The slide 41 includes a central wedge 49 that projects downwardly from the upper wall 50 of the slide through a central opening 51 in the upper wall 24 of the connector body 13. The bottom of the wedge 49, within the connector body 13, is defined by an inclined ramp 52 and a short flat surface 53 which is parallel to the upper wall 50.

Between the wedge 49 and the flat plate 30 of the pressure bar 29 is a leaf spring 54 which has a shallow V-shape. The ends of the spring 54 are bent to be received in the recess 31 in the upper surface of the plate 30. The upper portion of the spring 54 engages the ramp 52 of the wedge 49.

In use of the connector of this invention, two pins 56 are attached to the wiring board 12 at predetermined spaced locations. The undersurface of the board 12 at this area is reinforced by a stiffener plate 57. Contact pads 40 of the board are between the pins 56. The pins 56 include threaded outer ends 58, which engage threaded openings in the stiffener plate 57, and shoulders 59 that limit the axial movement of the pins so that their heads 60 are spaced a known distance above the surface of the board 12.

Figure 3:
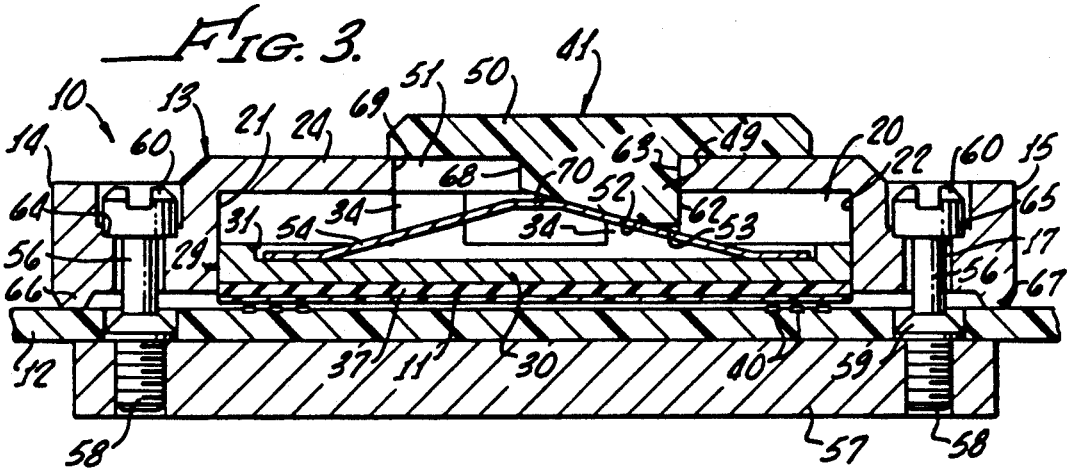
FIG. 3 is an enlarged longitudinal sectional view of the connector and printed circuit board with the connector in the unlocked position.

Prior to association of the connector 10 with the printed circuit board 12, the slide 41 is positioned as shown in FIG. 3 at the right hand-end of the opening 51 in the upper wall 24 of the connector body 13 with the end 62 of the wedge 49 engaging the end edge 63 of the opening 51. There the wedge 49 does not cause appreciable deflection of the spring 54. The connector 10, with its associated flexible circuit 11, then is positioned over the board 12 with the shanks of the pins 56 above the shoulders 59 being received in the slots 16 and 17 of the connector body 13. The connector 10 is moved onto the pins 56 until the pins reach the inner ends of the slots 16 and 17. Recesses 64 and 65 are provided at the inner ends of the slots to receive the heads 60 of the pins and accurately position the connector assembly relative to the board 12. In that location the raised features 39 on the underside of the flexible circuit 11 are directly opposite from the contact pads 40 on the board 12. Feet 66 and 67 on the bottom edges of the end projections 14 and 15 engage the upper surface of the printed circuit board 12.

Figure 4:
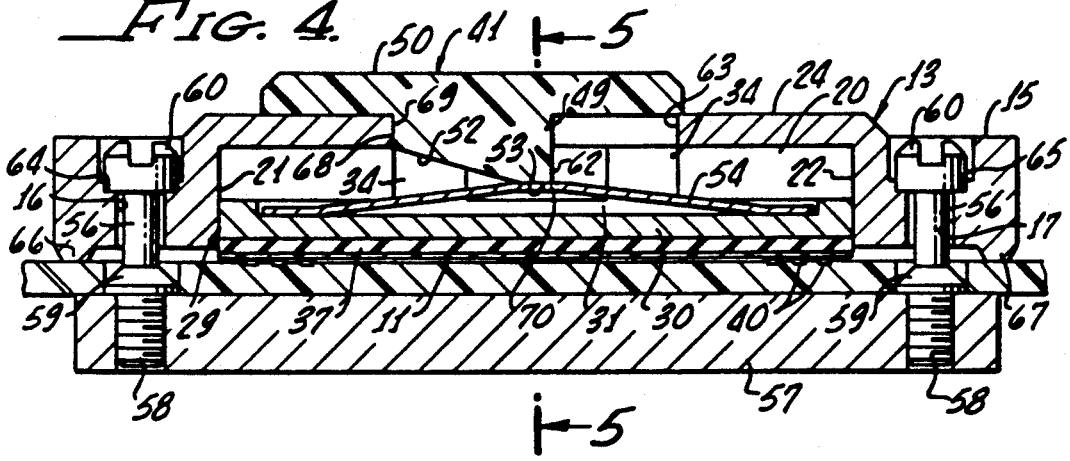
FIG. 4 is a view similar to FIG. 3 with the connector in the locked position.
Figure 5:
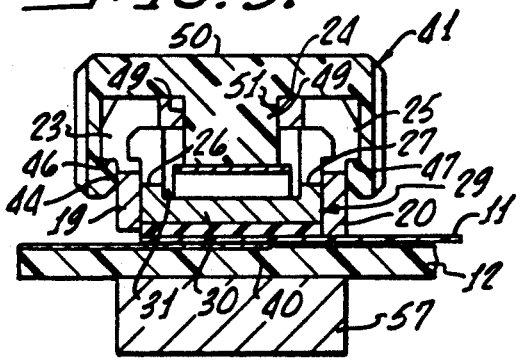
FIG. 5 is a transverse sectional view taken along line 5—5 of FIG. 4.
Figure 6:
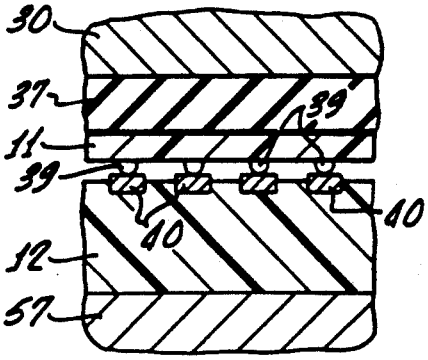
FIG. 6 is an enlarged fragmentary sectional view showing the interengagement of the contacts of the flexible circuit and of the printed circuit board.

Next, the slide 41 is moved to the opposite end of the opening 51 in the upper wall 24 of the connector body 13, as seen in FIG. 4. The end 68 of the wedge 49 then engages the end edge 69 of the opening 51. When this is done, the ramp 52 of the wedge 49 of the slide 41 deflects the spring 54 downwardly and the horizontal surface 49 is brought into engagement with a short horizontal surface 70 at the center of the spring. As a result, the spring 54 exerts a downward resilient force on the pressure bar 29 and the slide 41 is retained in its position. The pressure bar 29, through the resilient pad 38, forces the flexible circuit 11 down tightly against the board 12. This causes the raised features 39 of the flexible circuit 11 to make intimate contact with the pads 40 of the wiring board, completing an electrical connection between the two. The resilient pad 37 distributes the downward force of the spring uniformly and assures that all contacts are pressed firmly into interengagement irrespective of dimensional variations.

The reaction of the spring 54 against the slide 41 is transmitted by the flanges 44 and 45 of the slide to the shoulders 46 and 47 of the connector body 13. This forces the connector body 13 upwardly into tight engagement with the abutments formed by the heads 60 of the pins 56 and the pins transmit the reaction to the board 12. The reaction between the body 13 and the heads 60 locks the body to the board 12.

The foregoing detailed description is to be clearly understood as given by way of illustration and example only, the spirit and scope of this invention being limited solely by the appended claims.

What is claimed is:

1. An electrical connector device comprising a pressure exerting element, a structure including means for permitting limited movement of said pressure exerting element along a predetermined path, a flexible circuit connected to said pressure exerting element, said flexible circuit including contact means thereon, means for removably securing said structure to a printed circuit board, and means engaging said structure for moving said pressure exerting element in said predetermined path so as to move said flexible circuit and cause said contact means of said flexible circuit to engage contacts on a printed circuit board to which said structure is attached.

2. A .device as recited in claim 1 in which said means for moving said pressure exerting element includes means for exerting a resilient force on said pressure exerting element.

3. A device as recited in claim 1 in which said means for moving said pressure exerting element includes a member movable relative to said structure, and a spring engaging said pressure exerting element and deflectable upon such movement of said member so as to exert a resilient force on said pressure exerting member.

4. A device as recited in claim 1 in which said pressure exerting element includes a substantially flat plate, and a resilient pad secured to said substantially flat plate, said flexible circuit being secured to said resilient pad.

5. A device as recited in claim 1 in which said means for connecting said structure to a circuit board includes pin means having head means spaced a predetermined distance from the surface of a circuit board, said structure including slot means for receiving said pin means beneath said head means.

6. An electrical connector device comprising a body having a hollow interior defined by a top wall, two sidewalls and two end walls, said body having an open bottom wall, a pressure exerting member in said body, said pressure exerting member including a substantially flat plate and means for retaining said substantially flat plate within said body, a slide extending over said top wall and confined to linear movement relative to said body, said top wall including an opening therethrough, said slide including a portion extending through said opening into the interior of said body, a leaf spring between said portion and said substantially flat plate and arranged such that when said slide is one position relative to said top wall said spring is relatively relaxed and when said slide is in another position relative to said top wall said spring is deflected for biasing said pressure exerting member outwardly of said body, a resilient pad on the outer surface of said substantially flat plate, and a flexible circuit bonded to said pad, said flexible circuit having contact means facing outwardly away from said pad, said body including a duality of slots adapted to receive pins projecting from a circuit board for securing said body to such a circuit board, whereby when said body is so secured to a circuit board movement of said slide from said first position to said second position will cause said spring to bias said pressure exerting member, and with it said pad and said flexible circuit, toward such a circuit board to cause said contacts of said flexible circuit to engage and make an electrical connection with contacts of the circuit board.

7. In combination with a printed circuit board having contact means thereon, an electrical connector device comprising a pressure element having a rigid portion and a resilient portion, a structure including means for retaining said pressure element and permitting movement of said pressure element along a predetermined path, a flexible circuit secured to said resilient portion and having electrical contact means thereon facing away from said pressure element, resilient means for exerting a force on said pressure element for biasing said pressure element along said path in one direction, a duality of pin means projecting from said printed circuit board adjacent said contact means thereof, said pin means having abutment means thereon spaced a predetermined distance from said printed circuit board, said structure including recess means receiving said pin means for positioning said structure and thereby said flexible circuit adjacent said contact means of said printed circuit board, said resilient means so biasing said pressure element as to cause said contact means of said flexible circuit to engage and make electrical contact with said contact means of said printed circuit board, said structure engaging said abutment means for retaining said structure to said printed circuit board.

8. A device as recited in claim 7 in which said recess means comprises a duality of parallel slots which have open outer ends on the same side of said structure.

9. In combination with a printed circuit board having contact means thereon in a predetermined location, an electrical connector comprising a body having opposite sidewalls and an open bottom, a pressure bar in said body, said pressure bar including a substantially flat portion and a plurality of tabs projecting from said flat portion away from said open bottom, said tabs having outwardly projecting shoulders, said sidewalls having openings receiving said shoulders and having edges engageable by said shoulders for preventing separation of said pressure bar from said body, a resilient pad secured to said substantially flat portion and facing outwardly of said body, a flexible circuit secured to said pad, said flexible circuit including contact means facing away from said pad, a slide, said body and said slide having interengageable means for confining said slide to linear movement relative to said body, a leaf spring in said body engaging said pressure bar, said slide having a surface engaging said spring for deflecting said spring toward said pressure bar upon movement of said slide from a first position to a second position relative to said body, thereby to exert a force biasing said pressure bar outwardly of said body, said body including opposite end portions, each of said opposite end portions including a slot extending therein from one edge thereof, said slots being parallel and opening in the same direction, and a duality of spaced pins projecting from said board adjacent said contact means of said printed circuit board, said pins having heads thereon spaced a predetermined distance from said board, said pins being received in said slots for thereby positioning said flexible circuit with said contact means thereof aligned with said contact means of said printed circuit board, whereby upon movement of said slide from said first position to said second position said contact means of said flexible circuit and said printed circuit board are pressed into interengagement by said pressure bar and said beads of said pins prevent separation of said body from said printed circuit board.

10. A device as recited in claim 9 in which said substantially flat portion of said pressure bar includes a recess therein, said leaf spring including end portions received in said recess.

11. A device as recited in claim 9 in which for said interengageable means said sidewalls include shoulder means facing downwardly relative to said body, and said slide includes side portions overlying said side walls, said side portions including shoulder means facing upwardly relative to said body and positioned opposite from said shoulder means of said side walls.

12. A device as recited in claim 9 in which said body includes a top wall having an opening therein, said slide having a first portion extending over said top wall and a second portion extending through said opening and engaging said leaf spring for deflecting the same upon such movement of said slide relative to said body.

13. A device as recited in claim 12 in which said leaf spring is substantially V-shaped with the apical portion thereof being adjacent said second portion of said slide, said second portion of said slide including an incline ramp for so engaging and deflecting said leaf spring.

14. A device as recited in claim 12 in which said opening in said top wall includes opposite end edges, said second portion of said slide having surfaces engageable with said end edges for limiting the movement of said slide relative to said body.

* * * * *